US006409311B1

(12) United States Patent
Gooray et al.

(10) Patent No.: US 6,409,311 B1
(45) Date of Patent: Jun. 25, 2002

(54) BI-DIRECTIONAL FLUID EJECTION SYSTEMS AND METHODS

(75) Inventors: Arthur M. Gooray; George J. Roller, both of Penfield, NY (US); Joseph M. Crowley, Morgan Hill, CA (US); Paul C. Galambos; Frank J. Peter, both of Albuquerque, NM (US); Kevin R. Zavadil, Bernilillo, NM (US); Richard C. Givler, Albuquerque, NM (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/718,476

(22) Filed: Nov. 24, 2000

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 4,520,375 | A | 5/1985 | Kroll |
| 5,501,893 | A | 3/1996 | Laermer et al. |
| 5,668,579 | A | 9/1997 | Fujii et al. |
| 5,754,205 | A | 5/1998 | Miyata et al. |
| 5,783,340 | A | 7/1998 | Farino et al. |
| 5,798,283 | A | 8/1998 | Montague et al. |
| 5,804,084 | A | 9/1998 | Nasby et al. |
| 5,821,951 | A | 10/1998 | Fujii et al. |
| 5,828,394 | A | 10/1998 | Khuri-Yakub et al. |
| 5,919,548 | A | 7/1999 | Barron et al. |
| 5,963,788 | A | 10/1999 | Barron et al. |
| 6,082,208 | A | 7/2000 | Rodgers et al. |
| 6,127,198 | A | 10/2000 | Coleman et al. |

OTHER PUBLICATIONS

U.S. patent application Ser. No. 09/718,480, Gooray et al., filed Nov. 24, 2000.

*Primary Examiner*—Raquel Yvette Gordon
(74) *Attorney, Agent, or Firm*—Oliff & Berridge, PLC

(57) ABSTRACT

A bi-directional fluid ejector according to the systems and methods of this invention operates on the principle of electrostatic attraction. In various exemplary embodiments, the fluid ejector includes a sealed dual diaphragm arrangement, an electrode arrangement that is parallel and opposite to the sealed diaphragms, and a structure which contains the fluid to be ejected. A diaphragm chamber containing a relatively incompressible fluid is situated behind, and is sealed by, the diaphragms. At least one nozzle hole is formed in a faceplate of the ejector over one of the diaphragms. A drive signal is applied to at least one electrode of the electrode arrangement to generate an electrostatic field between the electrode and a first one of the diaphragms. The first diaphragm is attracted towards the electrode by an electrostatic force into a deformed shape due to the electrostatic field. Upon deforming, pressure is transmitted to a second one of the sealed diaphragms. The transmitted pressure and the relatively incompressible nature of the fluid contained within the sealed diaphragm chamber causes the second diaphragm to deflect in the opposite direction to force fluid through at least one of the at least one nozzle hole. After a drop is ejected, the movement is reversed, either through normal resilient restoration actions of the deformed diaphragm and/or through an applied force.

14 Claims, 6 Drawing Sheets

BI-DIRECTIONAL FLUID EJECTION SYSTEMS AND METHODS

BACKGROUND OF THE INVENTION

1. Field of Invention

This invention relates to micromachined or microelectromechanical system based fluid ejectors and fluid ejection methods.

2. Description of Related Art

Fluid ejectors have been developed for inkjet recording or printing. Ink jet recording apparatus offer numerous benefits, including extremely quiet operation when recording, high speed printing, a high degree of freedom in ink selection, and the ability to use low-cost plain paper. The so-called "drop-on-demand" drive method, where ink is output only when required for recording, is now the conventional approach. The drop-on-demand drive method makes it unnecessary to recover ink not needed for recording.

Fluid ejectors for inkjet printing include one or more nozzles which allow the formation and control of small ink droplets to permit high resolution, resulting in the ability to print sharper characters with improved tonal resolution. In particular, drop-on-demand inkjet print heads are generally used for high resolution printers.

Drop-on-demand technology generally uses some type of pulse generator to form and eject drops. For example, in one type of print head, a chamber having an ink nozzle may be fitted with a piezoelectric wall that is deformed when a voltage is applied. As a result of the deformation, the fluid is forced out of the nozzle orifice as a drop. The drop then impinges directly on an associated printing surface. Use of such a piezoelectric device as a driver is described in JP B-1990-51734.

Another type of print head uses bubbles formed by heat pulses to force fluid out of the nozzle. The drops are separated from the ink supply when the bubbles form. Use of pressure generated by heating the ink to generate bubbles is described in JP B-1986-59911.

Yet another type of drop-on-demand print head incorporates an electrostatic actuator. This type of print head utilizes electrostatic force to eject the ink. Examples of such electrostatic print heads are disclosed in U.S. Pat. No. 4,520,375 to Kroll and Japanese Laid-Open Patent Publication No. 289351/90. The ink jet head disclosed in the 375 patent uses an electrostatic actuator comprising a diaphragm that constitutes a part of an ink ejection chamber and a base plate disposed outside of the ink ejection chamber opposite to the diaphragm. The ink jet head ejects ink droplets through a nozzle communicating with the ink ejection chamber, by applying a time varying voltage between the diaphragm and the base plate. The diaphragm and the base plate thus act as a capacitor, which causes the diaphragm to be set into mechanical motion and the fluid to exit responsive to the diaphragm's motion. On the other hand, the ink jet head discussed in the Japan 351 distorts its diaphragm by applying a voltage to an electrostatic actuator fixed on the diaphragm. This result in suction of ink into an ink ejection chamber. Once the voltage is removed, the diaphragm is restored to its non-distorted condition, ejecting ink from the ink ejection chamber.

Fluid drop ejectors may be used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for usable as permanent and/or removable gaskets in micro-machines.

SUMMARY OF THE INVENTION

The systems and methods of this invention provide increased electrostatic potential for fluid ejection in an electrostatic fluid ejector.

The systems and methods of this invention separately provide greater fluid ejection velocity with an electrostatic fluid ejector.

The systems and methods of this invention separately provide a bi-directional mode for fluid ejection.

The systems and methods of this invention separately provide for compensation within a sealed chamber of a non-compressible fluid.

The systems and methods of this invention separately provide an actively powered ejection cycle for ejecting fluid from a fluid ejector.

The systems and methods of this invention separately provide increased force on a fluid over the cycle of a fluid ejector.

The systems and methods of this invention separately provide higher frequency performance.

The systems and methods of this invention separately utilize a high performance dielectric.

According to various exemplary embodiments of the systems and methods of this invention, a sealed dual diaphragm is used to eject a fluid from a fluid ejector.

According to various exemplary embodiments of the systems and methods of this invention, a sealed dual diaphragm arrangement is used operate a fluid ejector in a bi-directional mode. According to other various exemplary embodiments of the systems and methods of this invention, a dual electrode arrangement is used effectuate ejecting a fluid from a fluid ejector. According to further various exemplary embodiments of the systems and methods of this invention, a dual nozzle arrangement is used to effectuate ejecting a fluid from a fluid ejector.

According to various exemplary embodiments of the systems and methods of this invention, a fluid ejector comprises a containment structure for a fluid to be ejected, a sealed dual diaphragm and a dual electrode. In various other exemplary embodiments of the systems and methods of this invention, a dielectric fluid is sealed behind a two-part diaphragm. In various other exemplary embodiments of the systems and methods of this invention, the dielectric fluid may be a high performance dielectric fluid.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention described in detail below, with reference to the attached drawing figures, in which.

DETAILED DESCRIPTION OF EXEMPLARY EMBODIMENTS

Figure 1:
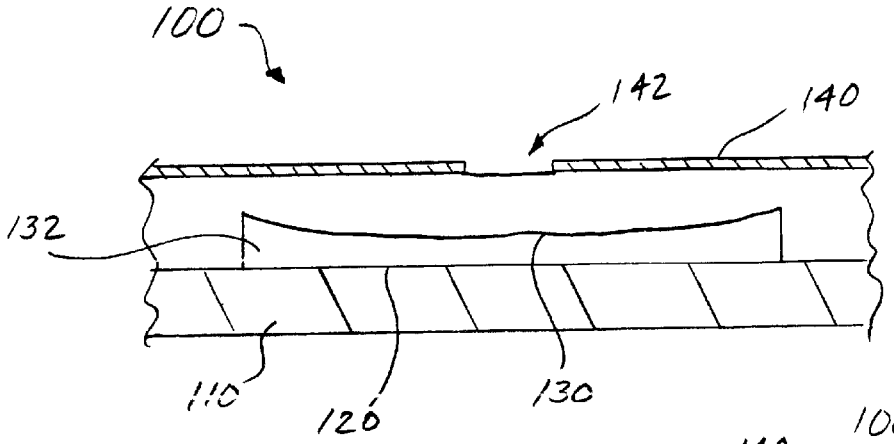
FIG. 1 is a cross-sectional view of an exemplary embodiment of a single fluid ejector using a sealed diaphragm in a state where the diaphragm is deflected.

A bi-directional fluid ejector according to the systems and methods of this invention operates on the principle of electrostatic attraction. The basic features of the fluid ejector include a sealed dual diaphragm arrangement, an electrode arrangement that is parallel and opposite to the dual sealed diaphragms, and a structure which contains the fluid which is to be ejected. A diaphragm chamber containing a relatively incompressible fluid is situated behind and sealed by the diaphragms. One of the diaphragms is situated opposite a nozzle hole formed in a faceplate of the ejector. A dual electrode arrangement is advantageous, but optional. A drive signal is applied to at least one electrode of the electrode arrangement to generate an electrostatic field between the at least one electrode and a first one of the diaphragms. The first diaphragm is attracted towards the at least one electrode by an electrostatic force of the generated electrostatic field into a deformed shape. Upon deforming, pressure is transmitted to a second one of the sealed diaphragms. The transmitted pressure and the relatively incompressible nature of the fluid, such a high performance dielectric fluid, contained within the sealed diaphragm chamber causes the second diaphragm to deflect in the opposite direction to force fluid through the nozzle hole. After a drop is ejected, the movement of the diaphragm(s) is reversed, either through normal resilient restoration actions of the deformed diaphragm(s) or through an applied force.

The systems and methods of this invention also contemplate a dual nozzle bi-directional fluid ejector. The sealed dual diaphragm arrangement is paired with a dual nozzle design in addition to a dual electrode arrangement which is parallel and opposite to the sealed diaphragms, as well as a structure which contains the fluid which is to be ejected. In these exemplary embodiments, an electrostatic force is generated between a first electrode and a first diaphragm and causes the first diaphragm to deform. Upon deforming, pressure is transmitted to a second diaphragm. The transmitted pressure and the relatively incompressible nature of the fluid, such as a high performance dielectric fluid, contained within the sealed diaphragm chamber causes the second diaphragm to deflect in the opposite direction to force fluid through a second nozzle hole. After ejecting the drop, the movement of the diaphragm(s) is reversed, either through normal resilient restoration actions of the deformed diaphragm(s) or through an applied force. When the first diaphragm returns to its undeformed position at a slow rate, for example through a controlled relaxation of the electrostatic field, no fluid is ejected through the corresponding nozzle hole. When the first diaphragm returns to its undeformed position at a high rate, as through an applied force, fluid is ejected through the corresponding nozzle hole. A higher frequency of operation is thus possible since both nozzle holes may be used to eject fluid during both of the alternating strokes of the cycle.

The bi-directional fluid ejector of this invention may be easily produced via monolithic batch fabrication based on the common production technique of silicon-based surface micro-machining and would have the potential for very low cost of production, high reliability and "on demand" drop size modulation. However, while the following discussion of the systems and methods of this invention may refer to aspects specific to silicon based surface micromachining, in fact other materials and production techniques for the bi-directional fluid ejector of this invention are possible. Also, the systems and methods of the invention may be utilized in any mechanical configuration of such an ejector (e.g., "roof shooter" or "edge shooter") and in any size array of ejectors.

Figure 2:
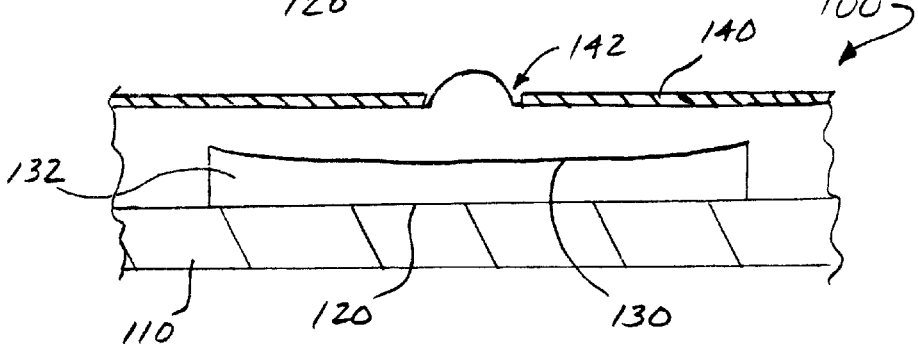
FIG. 2 is a cross-sectional view of the single fluid ejector of FIG. 1 in a state where the diaphragm is ejecting a drop of fluid.
Figure 3:
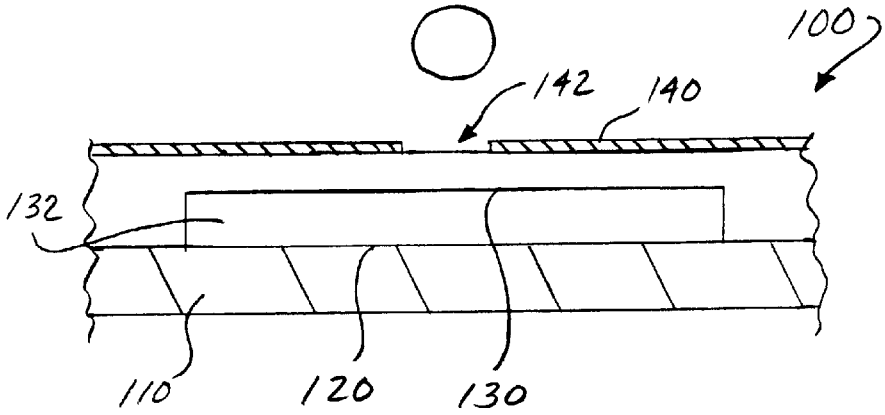
FIG. 3 is a cross-sectional view of the single fluid ejector of FIG. 1 in a state where the diaphragm is at rest.

FIGS. 1–3 show a simplified illustration of a single ejector in a "roof shooter" configuration is shown in FIGS. 1–3. As shown in FIG. 1, the ejector 100 includes a base plate 110, an electrode 120, a diaphragm 130 and a faceplate 140 with a nozzle hole 142. A diaphragm chamber 132 is sealed from the fluid to be ejected by the diaphragm 130. In this example, air is contained in the diaphragm chamber 132.

FIG. 3 shows an initial state of operation with the diaphragm 130 in an undeflected state. As shown in FIG. 1, as an electrostatic field is generated across the air gap between the electrode 120 and the diaphragm 130, the diaphragm 130 is deflected into a deflected state. As the diaphragm 130 is deflected, fluid is drawn into the space created by the deflected diaphragm 130 from a reservoir, which may be located at any part of the periphery of the ejector 100.

Assuming a uniform applied electrostatic force across the diaphragm 130, the relationships may be approximated as follows:

$$F=(\kappa\epsilon_o A)(E^2)/2 \tag{1}$$

where:

$\kappa$ is the relative permitivity ($=\epsilon/\epsilon_o$) also called dielectric constant, of the fluid;

$\epsilon_o$ is the permitivity of free space (i.e., vacuum),;

A is the cross sectional area of the electrode; and

E is the electrostatic field strength.

This may be recast as an applied pressure as follows:

$$P=(\kappa\epsilon_o)(E^2)/2. \tag{2}$$

For a circular diaphragm of diameter "d" (radius "r"), the maximum deflection occurring at the center of the diaphragm is approximately:

$$\delta=(Pr^4)/(64D); \tag{3}$$

where:

$D=(Et^3)/(12(1-u^2))$;

E is Young's Modulus;

t is the diaphragm thickness; and u is Poisson's ratio.

In actuality, as the diaphragm 130 deflects, the center of the diaphragm 130 will experience an electrostatic field, and hence a force, which is different than that experienced by the periphery of the diaphragm 130. These relationships, however, serve to illustrate the basic approach.

Figure 4:
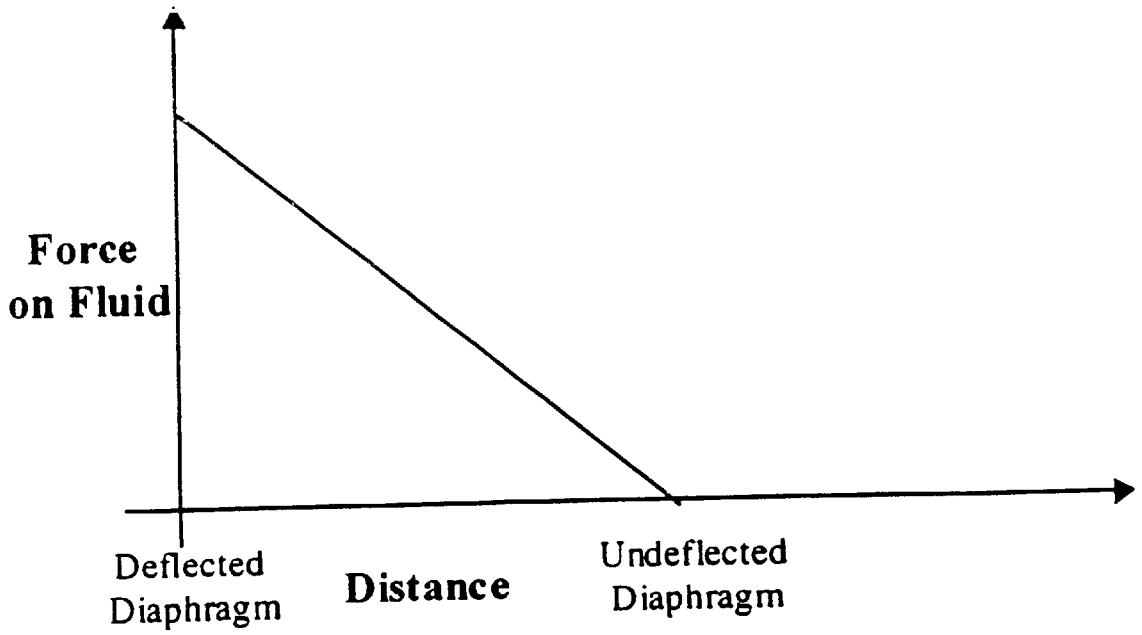
FIG. 4 is a plot of force versus distance for the single fluid ejector shown in FIGS. 1–3.

When the fluid is to be ejected, the electrostatic field is removed so that the resilient restoration force of the diaphragm 130 causes the diaphragm 130 to return to its undeflected state shown in FIG. 3. FIG. 2 shows an intermediate non-static state between the deflected and undeflected states shown in FIGS. 1 and 3, respectively. The resilient restoration force is transferred to the fluid, causing some fluid to be forced back into the reservoir and some fluid to be ejected through the nozzle hole 142, as shown in FIG. 3. This action is somewhat analogous to a "cocked" spring. The percentage of the fluid which is expelled as a drop, relative to the amount of fluid being moved by the diaphragm 130, may be controlled through specific design parameters of the ejector 100. Such parameters include the size of the diaphragm 130, the applied force, the distance between the diaphragm 130 and the faceplate 140 and other unique dimensions and features that may help govern flow, such as, for example, incorporating valves into the ejector 100. FIG. 4 shows, for a given area and given electrostatic field strength, an approximate qualitative relationship between the applied force on the fluid and the deflection of the diaphragm 130.

As seen from the equations governing the deflection of the diaphragm 130, a key parameter limiting the available force exerted on the fluid during ejection is the dielectric constant of the compressible fluid in the diaphragm chamber 132. In this case, air has a dielectric constant of approximately 1. While using air as the working dielectric may offer simplified manufacturing, doing so may limit the achievable drop size and velocity, impacting print quality, in the case of ink-jet print heads, and overall performance of the ejector 100.

Various exemplary embodiments of the systems and methods of this invention overcome such drawbacks. In the first exemplary embodiment of the bi-directional fluid ejector according to this invention, shown in FIGS. 5–7, a fluid ejector 200 has a sealed dual diaphragm arrangement comprising a first diaphragm 210, a second diaphragm 212 and a diaphragm chamber 214 comprising first and second compartments 216 and 218 which are in fluid communication with each other. The diaphragm chamber 214 contains an incompressible dielectric fluid 215. The diaphragm chamber 214 may have one or more support posts 202 that provide a support point for deflection of both of the diaphragms 210 and 212.

In various exemplary embodiments, the ejector 200 also has a dual electrode arrangement comprising a first electrode 220 and a second electrode 222. Each electrode 220, 222 is parallel and opposite to a corresponding one of the diaphragms 210 and 212.

A fluid 230 to be ejected is supplied to the ejector 200. The ejector 200 includes a faceplate 240 with a nozzle hole 242 through which the fluid 230 is ejected.

Figure 5:
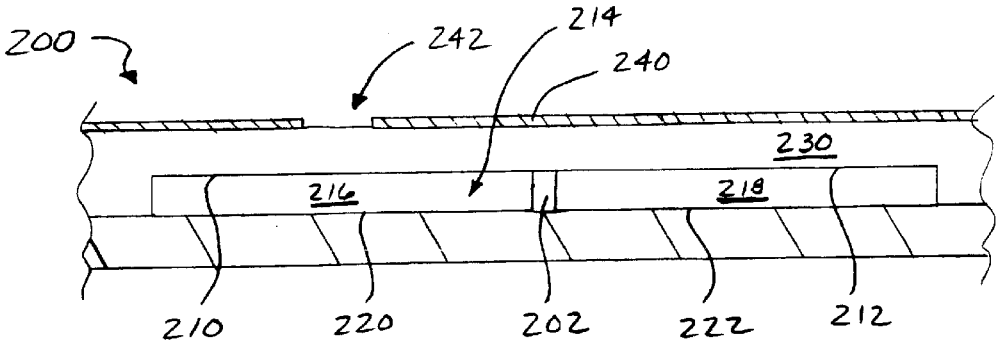
FIGS. 5–7 are cross-sectional views of a first exemplary embodiment of a bi-directional fluid ejector according to this invention in different states.
Figure 6:
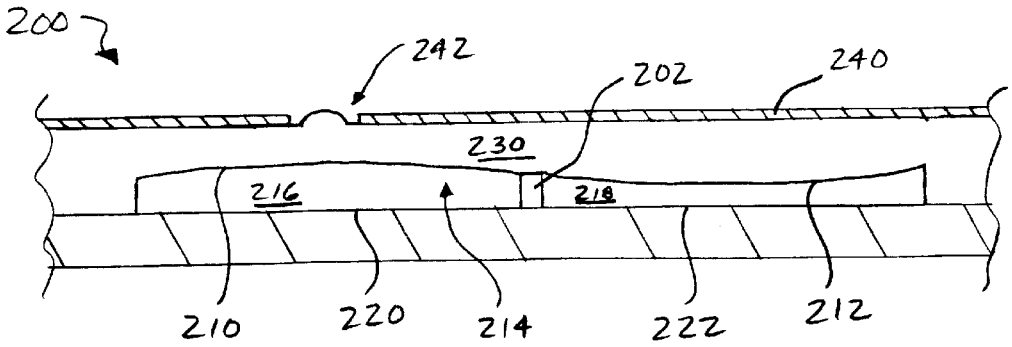
Figure 7:
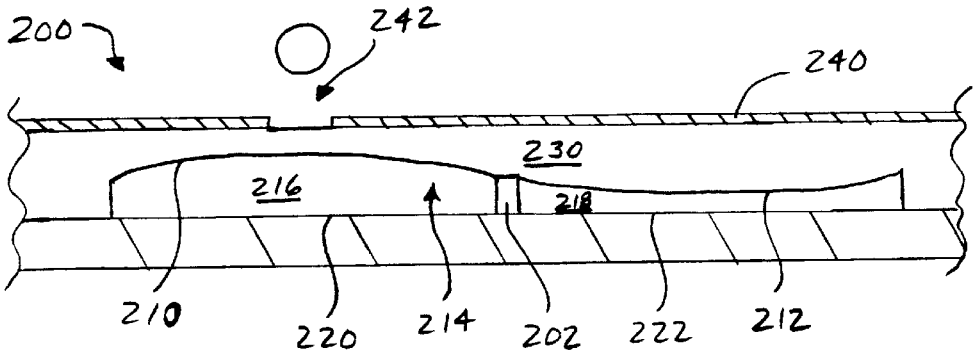

The ejector 200 operates on the principle of electrostatic attraction in a bi-directional mode as illustrated in FIGS. 5–7. FIG. 5 shows an initial state and FIGS. 6–7 show a fluid drop being ejected. A drive signal is applied to the second electrode 222 to generated an electrostatic field between the second electrode 222 and the second diaphragm 212. As shown in FIG. 6, an attractive electrostatic force causes the second diaphragm 212 to deflect towards the second electrode 222 into a deformed state. Upon deforming, a pressure is transmitted from the second compartment 218 of the diaphragm chamber 214 to the first compartment 216 and the first diaphragm 210. Due to the relatively incompressible nature of the fluid 215 contained within the diaphragm chamber 214, the transmitted pressure causes the first diaphragm 210 to deflect in the opposite direction, thus providing a force to expel a drop of fluid through the nozzle hole 242. After the drop is ejected, the movement is reversed, either through resilient restoration actions of the deformed diaphragms 210 and 212 and/or through an applied force.

For example, a drive signal may be sent to the first electrode 220 to generate an electrostatic field between the first electrode 220 and the first diaphragm 210. Thus, the first diaphragm 210 may effectively be driven bi-directionally. Providing of a second electrode assists in refilling the fluid 230 and increases the maximum operating frequency. After a drop is ejected, the electrostatic field across the second electrode 222 is removed, and an electrostatic field is generated between the first electrode 220 and the first diaphragm 210 to actively power a refill cycle.

Figure 8:
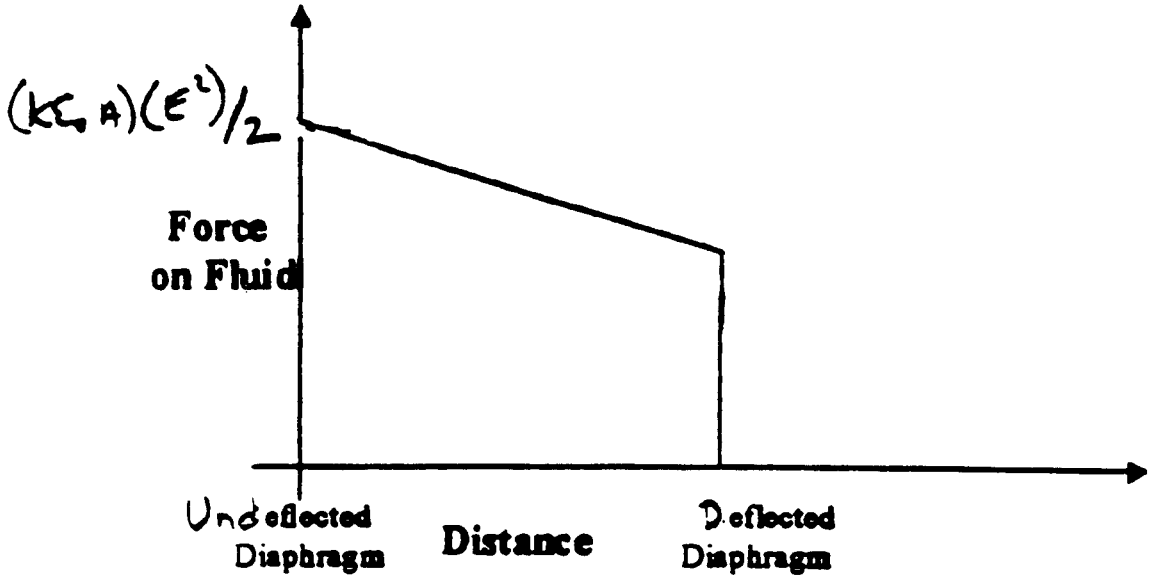
FIG. 8 is a plot of force versus distance for the exemplary embodiment of the bi-directional fluid ejector shown in FIGS. 5–7.

FIG. 8 qualitatively shows the force exerted on the fluid 230 to be ejected created by including the actively powered ejection cycle. A significantly increased force over the cycle is achieved in the exemplary embodiment of a bi-directional fluid ejector shown in FIGS. 5–7 relative to the exemplary embodiment shown in FIGS. 1–3, as can be seen by comparing FIG. 8 with FIG. 4.

As previously described above with respect to the ejector 100 shown in FIGS. 1–3, the percentage of the fluid 230 which is expelled as a drop, relative to the amount of fluid being moved by the diaphragms 210 and 212, may be controlled through specific design parameters of the ejector 200. The parameters include the sizes of the diaphragms 210 and 212, the applied force(s), the distance between the diaphragms 210 and 212 and the faceplate 240 and other dimensions and unique features that may help govern flow, such as, for example, incorporating valves into the ejector 200. An additional variable that may be used as a design parameter is the relative sizes of the first and second diaphragms 210 and 212.

While air is used in the uni-directional device previously disclosed and described, in various exemplary embodiments of the bi-directional fluid ejectors according to this invention, a high performance incompressible dielectric fluid is used to enable significantly higher forces to be applied to the fluid. For example, distilled water has a dielectric constant, $\kappa$, of about 78. This means that a diaphragm structure may be designed to allow about 78 times the "spring" force to be applied to the fluid to be ejected as compared to the approach using air as the dielectric fluid. Distilled water also has a very low conductivity, about $10^{-6}$ S/m, which enables low energy usage. Other dielectric fluids such as S-fluids, T-fluids, oils, organic solutions, etc. may be used. S-fluids and T-fluids are test fluids having the same composition as various inks such as, for example, dye-based aqueous inks, microemulsion inks, liquid crystalline inks, hot-melt inks, liposomic inks, and pigmented inks, without any pigments or dyes.

FIGS. 9–14 show a second exemplary embodiment of a bi-directional fluid ejector 300 and illustrate different operational stages of the fluid ejector 300. The ejector 300 has first and second nozzle holes 342 and 344.

The fluid ejector 300 has a sealed dual diaphragm arrangement comprising a first diaphragm 310, a second diaphragm 312 and a diaphragm chamber 314 comprising first and second compartments 316 and 318 which are in fluid communication with each other. The diaphragm chamber 314 contains a dielectric fluid 315. The diaphragm chamber 314 may have one or more support posts 302 that provide a support point for deflection of both diaphragms 310 and 312.

In various exemplary embodiments, the ejector 300 also has a dual electrode arrangement comprising a first electrode 320 and a second electrode 322. Each electrode 320, 322 is parallel and opposite to a corresponding diaphragm 310 and 312.

A fluid 330 to be ejected is supplied to the ejector 300. The ejector 300 includes a faceplate 340 with the first and second nozzle holes 342 and 344 through which the fluid 330 is ejected.

Figure 9:
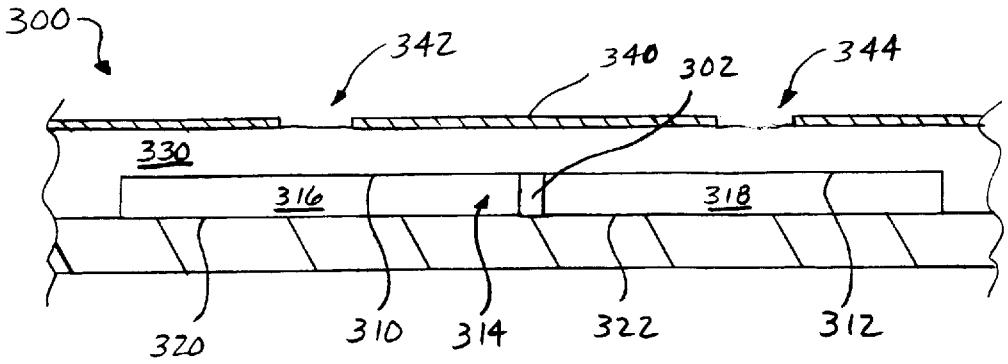
FIGS. 9–11 are cross-sectional views of a second exemplary embodiment of a bi-directional fluid ejector according to this invention in different states of a front half-cycle.
Figure 10:
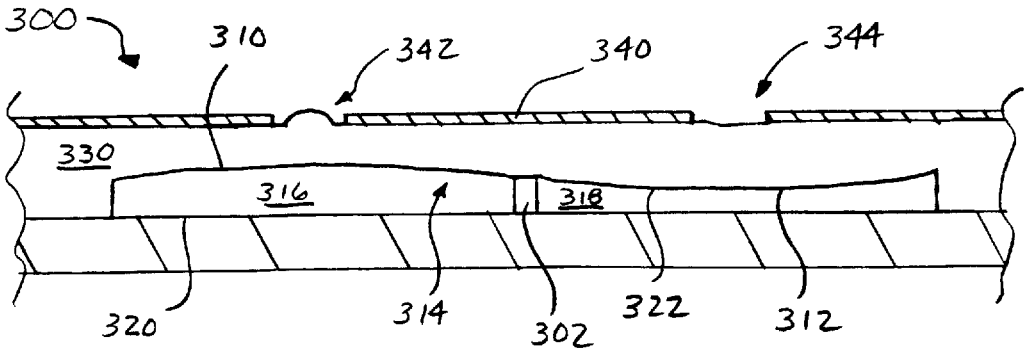
Figure 11:
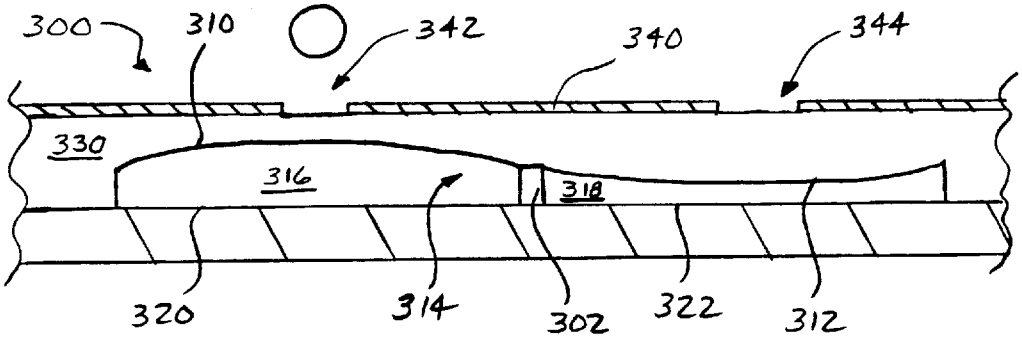
Figure 12:
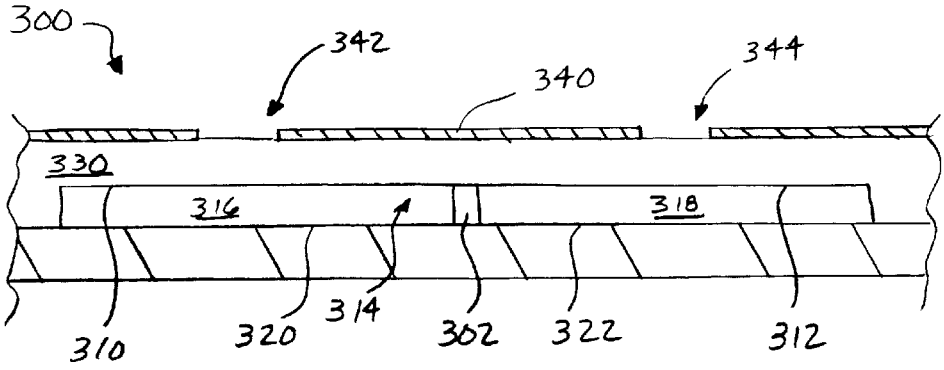
FIGS. 12–14 are cross-sectional views of the exemplary embodiment of the bi-directional fluid ejector shown in FIGS. 9–11 in different states of a back half-cycle.
Figure 13:
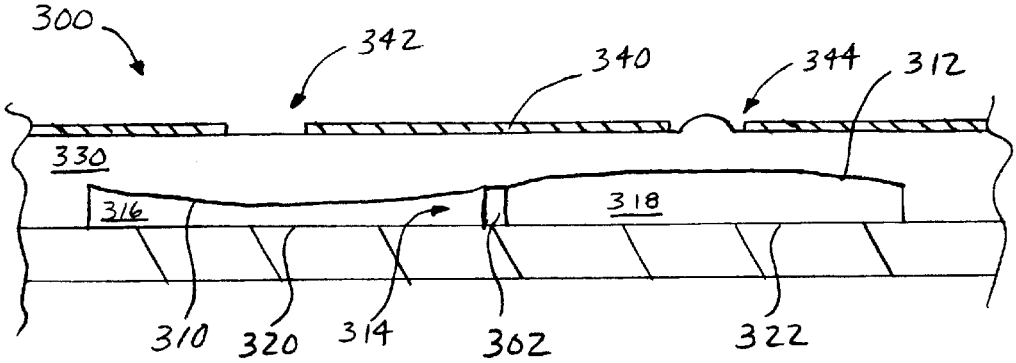
Figure 14:
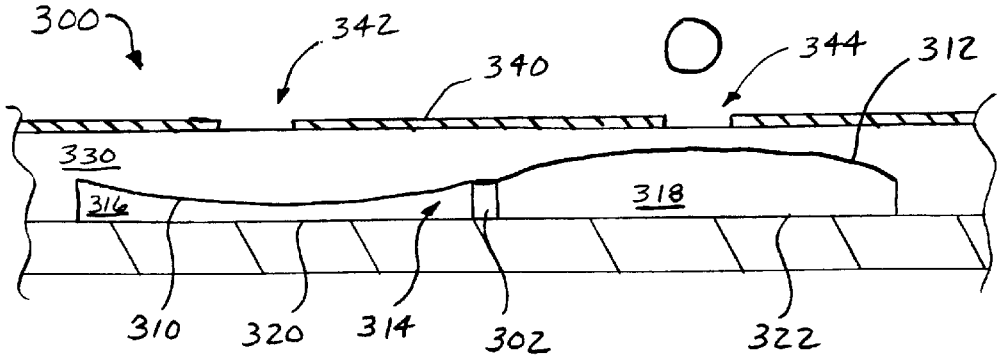

The ejector 300 operates on the principle of electrostatic attraction in a bi-directional mode as illustrated in FIGS. 9–14. FIG. 9 shows an initial state and FIGS. 10 and 11 show a fluid drop being ejected. FIGS. 12–14 show the return states with ejection of a fluid drop through the second nozzle hole 344.

In operation, a drive signal is applied to the second electrode 322 to generated an electrostatic field between the second electrode 322 and the second diaphragm 312. An attractive electrostatic force causes the second diaphragm 312 to deflect towards the second electrode 322 into a deformed state. Upon deforming, pressure is transmitted from the second compartment 318 of the diaphragm chamber 314 to the first compartment 316 and the first diaphragm 310. Due to the relatively incompressible nature of the fluid contained within the diaphragm chamber 314, the transmitted pressure causes the first diaphragm 310 to deflect in the opposite direction, thus providing a force to expel fluid through the first nozzle hole 342. After a drop is ejected through the first nozzle hole 342, the movement of the diaphragms 310 and 312 is reversed, either through resilient restoration actions of the deformed diaphragms 310 and 312 and/or through an applied force. This results in a fluid drop being ejected from the second nozzle hole 344. When the first diaphragm 310 returns to its undeformed position at a slow rate, as through a gradual reduction in the applied electrostatic field, no drop is expelled through the second nozzle hole 344. Such a configuration offers higher frequency performance than a single nozzle configuration.

If needed, a modulated drive signal as disclosed in copending U.S. patent application Ser. No. 09/718,480, which is incorporated herein by reference in its entirety, may be used to increase dielectric fluid breakdown latitude. The essence of this approach is using a substantially constant electrostatic field throughout the "cocking" motion of the diaphragm. For fluids whose breakdown strength changes as the critical breakdown dimension change, the input drive signal may be suitably tailored to obtain substantially the maximum possible field strength. In more detail, to minimize the chance of electrical breakdown or other electrochemical reactions occurring within the dielectric fluid, the drive signal may be tailored to have certain specified characteristics. For example, the system may be driven at a suitably high frequency. Alternatively, or additionally, a bi-polar pulse train at the desired frequency may be used.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for ejecting a fluid from a fluid ejector, comprising:

generating a first electrostatic force that moves a first diaphragm of a dual diaphragm arrangement of a fluid ejector in a first direction; and ejecting fluid from the fluid ejector by moving a second diaphragm in a second direction opposite the first direction in response to movement of the first diaphragm in the first direction.

2. The method of claim 1, further comprising:

replenishing a supply of fluid adjacent the second diaphragm by removing the first electrostatic force and generating a second electrostatic force that moves the second diaphragm in the first direction at least to a rest position.

3. The method of claim 2, wherein removing the first electrostatic force comprises removing the first electrostatic force sufficiently rapidly that the first and second diaphragms move past the rest position and fluid is ejected by moving the first diaphragm in the second direction.

4. The method of claim 1, further comprising:

replenishing a supply of fluid adjacent the second diaphragm by removing the first electrostatic force such that the first and second diaphragms resiliently move to a rest position.

5. The method of claim 1, further comprising:

generating a second electrostatic force that moves the second diaphragm in the first direction; and ejecting fluid from the fluid ejector by moving the first diaphragm in the second direction in response to movement of the second diaphragm in the first direction.

6. The method of claim 5, further comprising:

replenishing a supply of fluid adjacent the second diaphragm by moving the first diaphragm in the second direction; and replenishing a supply of fluid adjacent the first diaphragm by moving the second diaphragm in the second direction.

7. A bi-directional fluid ejection system, comprising:

a sealed dual diaphragm arrangement including:

a first diaphragm portion;

a second diaphragm portion; and a diaphragm chamber defined at least partially by the first and second diaphragm portions;

a first electrode opposite the first diaphragm portion; and a first nozzle hole located over the second diaphragm portion.

8. The system of claim 7, further comprising:

at least one support post that provides a support point for deflection of the first and second diaphragm portions.

9. The system of claim 7, further comprising:

an incompressible dielectric fluid contained in the diaphragm chamber.

10. The system of claim 9, wherein the dielectric fluid is a high performance dielectric fluid.

11. The system of claim 10, wherein the dielectric fluid is at least one of distilled water, an S-fluid, a T-fluid, an oil and an organic solution.

12. The system of claim 7, further comprising a second nozzle hole located over the first diaphragm.

13. The system of claim 12, further comprising a second nozzle hole located over the first diaphragm.

14. The system of claim 7, further comprising a second electrode opposite the second diaphragm.

* * * * *

UNITED STATES PATENT AND TRADEMARK OFFICE

CERTIFICATE OF CORRECTION

PATENT NO. : 6,409,311 B1
DATED : June 25, 2002
INVENTOR(S) : Gooray et al.

It is certified that error appears in the above-identified patent and that said Letters Patent is hereby corrected as shown below:

Column 1,
After the Title, please insert the following paragraph:

-- GOVERNMENT RIGHTS
This invention was made with Government support under Contract No. DE-AC04-94AL85000 awarded by the U.S. Department of Energy. The Government has certain rights in the invention. --

Signed and Sealed this

Third Day of December, 2002

JAMES E. ROGAN
*Director of the United States Patent and Trademark Office*